US010400642B2

(12) United States Patent
Ritter

(10) Patent No.: US 10,400,642 B2
(45) Date of Patent: Sep. 3, 2019

(54) METHOD FOR OPERATING AN OIL CIRCUIT, IN PARTICULAR FOR A VEHICLE

(71) Applicant: MAN Truck & Bus AG, München (DE)

(72) Inventor: Jürgen Ritter, Nuremberg (DE)

(73) Assignee: MAN Truck & Bus AG, Munich (DE)

( * ) Notice: Subject to any disclaimer, the term of this patent is extended or adjusted under 35 U.S.C. 154(b) by 334 days.

(21) Appl. No.: 15/260,576

(22) Filed: Sep. 9, 2016

(65) Prior Publication Data

US 2017/0074131 A1 Mar. 16, 2017

(30) Foreign Application Priority Data

Sep. 10, 2015 (DE) ..... 10 2015 011 852

(51) Int. Cl.
*F01M 5/00* (2006.01)
*F01P 11/08* (2006.01)

(52) U.S. Cl.
CPC ..... *F01M 5/005* (2013.01); *F01M 5/002* (2013.01); *F01P 11/08* (2013.01); *F01M 2250/60* (2013.01); *F01M 2250/62* (2013.01)

(58) Field of Classification Search
CPC ..... F01M 5/005; F01M 2250/60; F01M 2250/62; F01P 11/08
See application file for complete search history.

(56) References Cited

U.S. PATENT DOCUMENTS 4,231,331 A * 11/1980 Suzuki ..... F02P 5/15 123/406.48
4,258,676 A * 3/1981 Lamm ..... B60H 1/02 123/142.5 R
4,399,774 A * 8/1983 Tsutsumi ..... F01P 7/167 123/196 AB
5,875,763 A * 3/1999 Mottier ..... F02P 3/0456 123/406.13
5,887,562 A * 3/1999 von Esebeck ..... F01M 1/12 123/196 AB (Continued)

FOREIGN PATENT DOCUMENTS

DE 102013009275 12/2014
DE 102014018729 6/2015
WO WO 2011/133164 10/2011

*Primary Examiner* — Michael A Riegelman
(74) *Attorney, Agent, or Firm* — Cozen O'Connor

(57) ABSTRACT

A method for operating an oil circuit for a vehicle, the oil circuit being configured to supply oil to an internal combustion engine, wherein the oil circuit includes an oil cooler, and wherein at least one temperature sensor measures the temperature of the oil flowing through the oil circuit, downstream of the oil cooler and upstream of the internal combustion engine, the temperature sensor being connected for signaling purposes to a regulating and/or control device, includes: controlling and/or regulating, by the regulating and/or control device, the temperature of the oil flowing through the oil circuit, such that the temperature measured by the temperature sensor has a defined target temperature value; and setting and/or adjusting, by the regulating and/or control device, as a function of a drive power of the internal combustion engine, the defined target temperature value so as to reduce fuel consumption of the internal combustion engine.

18 Claims, 3 Drawing Sheets

(56) References Cited

U.S. PATENT DOCUMENTS

| | | | | |
|---|---|---|---|---|
| 2013/0180478 | A1* | 7/2013 | Ceynow | F01M 5/005 123/41.08 |
| 2015/0044036 | A1* | 2/2015 | Fitzpatrick | F02C 7/14 415/175 |
| 2015/0075481 | A1* | 3/2015 | Cattani | F01M 5/005 123/196 AB |
| 2016/0290189 | A1* | 10/2016 | Nakazono | F01P 7/167 |
| 2017/0074131 | A1* | 3/2017 | Ritter | F01M 5/005 |
| 2017/0167330 | A1* | 6/2017 | Lee | F01M 1/02 |
| 2018/0087414 | A1* | 3/2018 | Baxter | F01M 1/02 |

* cited by examiner

METHOD FOR OPERATING AN OIL CIRCUIT, IN PARTICULAR FOR A VEHICLE

BACKGROUND OF THE INVENTION

1. Field of the Invention

The invention relates to a method for operating an oil circuit, in particular for a vehicle, a device for a vehicle, in particular for a commercial vehicle, and a vehicle, in particular a commercial vehicle, for performing the method and/or with the device.

2. Description of the Related Art

An internal combustion engine is usually supplied with oil by an oil circuit. The oil can be used in this case for both lubricating the internal combustion engine and also for cooling the internal combustion engine. Such an oil circuit regularly comprises at least one oil cooler, by which the oil flowing through the oil circuit is cooled. The oil cooler is often in the form of a heat absorbing heat exchanger of a coolant circuit, by which both the internal combustion engine and also the oil flowing through the oil circuit can be cooled.

Furthermore, the oil circuit usually also comprises at least one temperature sensor, by which the temperature of the oil flowing through the oil circuit is measured downstream of the oil cooler and upstream of the internal combustion engine when looking in the direction of flow of the oil. By the temperature sensor, it can be checked or monitored whether or not the oil flowing through the oil circuit is at the desired temperature. The oil circuit is usually configured such that the oil flowing through the oil circuit has a working temperature of 85 to 100° C. in the region of the temperature sensor in a wide region of the working point of the engine. Owing to such a working temperature of the oil, it is prevented that the oil, in particular with the internal combustion engine under full load, is heated strongly such that it is damaged or high mixed friction occurs.

SUMMARY OF THE INVENTION

It is an object of the invention to provide a method for operating an oil circuit, in particular for a vehicle, and a device for a vehicle, in particular for a commercial vehicle, by which the fuel consumption of the internal combustion engine can be reduced in a simple and effective manner.

In accordance with one aspect of the invention, a method for operating an oil circuit, in particular for a vehicle, is proposed, whereby by the oil circuit an internal combustion engine is supplied with oil, whereby the oil circuit comprises at least one oil cooler, by which the oil flowing through the oil circuit is cooled, and wherein at least one temperature sensor is provided, by which the temperature of the oil flowing through the oil circuit is measured, in particular downstream of the oil cooler and upstream of the internal combustion engine. According to an aspect of the invention, the temperature sensor is connected for signaling purposes to a regulating and/or control device, by which the temperature of the oil flowing through the oil circuit is controlled and/or regulated such that the temperature measured by the temperature sensor has a defined target temperature value. In addition, in particular for reducing the fuel consumption of the internal combustion engine, the target temperature value is adjusted and/or displaced by the regulating and/or control device as a function of the drive power, in particular as a function of the drive torque and/or as a function of the drive revolution rate, of the internal combustion engine.

In this way the fuel consumption of the internal combustion engine can be reduced simply and effectively, because the temperature of the oil flowing through the oil circuit in the region of the temperature sensor is now adjusted or changed by the regulating and/or control device as a function of the drive power of the internal combustion engine. For example, at a lower drive power of the internal combustion engine a higher target temperature value can be set. As a result, the viscosity of the oil and hence also the fuel consumption of the internal combustion engine is reduced. Owing to the low drive power of the internal combustion engine, the oil is also not heated in the region of the internal combustion engine so much that it is damaged. At a greater drive power of the internal combustion engine, for example, a lower target temperature value can be set or adjusted by the regulating and/or control device. As a result, it is ensured that the oil is not heated greatly by the internal combustion engine so that it is decomposed. With the procedure according to the invention, the temperature of the oil flowing through the oil circuit can thus always be set such that the internal combustion engine has a minimal fuel consumption. As a result, the harmful emissions emitted by the internal combustion engine can be reduced.

The term "temperature sensor" is expressly to be understood here in a wide sense. Thus the temperature sensor can be in the form of any temperature detecting device here, by which the temperature of the oil flowing through the oil circuit can be detected. However, it is preferred if the temperature of the oil is measured by a temperature sensor, for example by a thermoelement.

In a preferred procedure, if the drive power of the internal combustion engine exceeds a defined drive power value, a first temperature value is set as a target temperature value. If the drive power of the internal combustion engine does not exceed the defined drive power value, then a second temperature value that is higher than the first temperature value can be set as the target temperature value. In this way the fuel consumption of the internal combustion engine can be simply and effectively reduced. Preferably in addition, at least one characteristic field is stored in the regulating and/or control device, in which the target temperature value is entered as a function of the drive power of the internal combustion engine.

Preferably, in the full load mode of the internal combustion engine and/or in the partial load mode of the internal combustion engine in the upper partial load region, a temperature value of 85° C. to 100° C., preferably of 85° C. to 95° C., is set as the target temperature value. By such a target temperature value, it is reliably ensured that the oil flowing through the oil circuit in full load mode and/or in the upper partial load region of the internal combustion engine is not heated too much by the internal combustion engine.

It is further preferred that in the partial load mode of the internal combustion engine in the lower and/or middle partial load region, a temperature value of 105° C. to 120° C., preferably of 110° C. to 120° C., is set as the defined target temperature value. As a result, the fuel consumption of the internal combustion engine can be reduced in a simple way in the lower or middle partial load region of the internal combustion engine, without damaging the oil flowing through the oil circuit and reducing the carrying capacity of the oil too much.

In a particularly preferred embodiment, the oil circuit comprises at least one bypass channel, by which at least a part of the oil flowing through the oil circuit can bypass the oil cooler, whereby the regulating and/or control device comprises an actuator for controlling or regulating the oil temperature, by which the amount of the oil flowing through the bypass channel and the amount of oil passed via the oil cooler can be set and/or adjusted. By the bypass channel and the actuator, the temperature of the oil flowing through the oil circuit can be particularly simply and effectively set or adjusted by the regulating and/or control device. As a result, the fuel consumption of the internal combustion engine can also be reduced particularly effectively. Preferably, it is provided in this case that the temperature of the oil flowing through the oil circuit is measured by the temperature sensor downstream of an oil outlet of the bypass channel and upstream of the internal combustion engine when looking in the direction of flow of the oil.

The actuator is preferably formed by at least one valve. Preferably, it is provided in this case that the valve is formed by a regulated and/or controlled valve, in particular by a regulated and/or controlled directional control valve, in order to be able to adjust the temperature of the oil flowing through the oil circuit in a particularly flexible way and always as desired.

More preferably, a coolant circuit is provided, by which the internal combustion engine and the oil cooler or the oil circuit can be cooled by a coolant, whereby in the event of a cold start of the internal combustion engine, all the oil is passed via the oil cooler. In this way the oil flowing through the oil circuit can be heated particularly rapidly during a cold start because the coolant flowing through the coolant circuit during a cold start is heated more rapidly than the oil flowing through the oil circuit. Alternatively and/or in addition, during a cold start of the internal combustion engine, in which the oil temperature lies below a defined temperature value, preferably below 10° C., all the oil can be passed through the bypass channel. As a result, damage to the oil cooler owing to the particularly viscous or highly viscous oil at low temperatures and the high oil pressure resulting therefrom is effectively counteracted.

Preferably, the oil circuit comprises at least one regulated oil pump, by which the oil is transported through the oil circuit, whereby the oil pump and hence the amount of oil transported by the oil pump is regulated and/or controlled by the regulating and/or control device to control the temperature of the oil flowing through the oil circuit. In this way the temperature of the oil flowing through the oil circuit can also be set or adjusted simply and effectively by the regulating and/or control device.

It is also preferable that a coolant circuit is provided, by which the internal combustion engine and the oil cooler or the oil circuit are cooled by a coolant, whereby at least one component of the coolant circuit that influences the cooling of the oil cooler or of the oil circuit is regulated and/or controlled by the regulating and/or control device for controlling the temperature of the oil flowing through the oil circuit. As a result, the temperature of the oil flowing through the oil circuit can also be simply and effectively set or adjusted by the regulating and/or control device.

In a preferred embodiment, the at least one component of the coolant circuit is formed by a fan for cooling a heat dissipating heat exchanger of the coolant circuit and/or by a regulated coolant pump and/or by a regulated thermostatic valve. By the components, the cooling of the oil circuit can be simply and effectively set or adjusted.

In a further preferred embodiment, the regulating and/or control device is connected for signaling purposes to a prediction device, by which the expected drive power, in particular the expected drive torque and/or the expected drive revolution rate, of the internal combustion engine in a segment of the route ahead of a vehicle comprising the drive device can be determined, whereby the target temperature value is already set or adjusted by the regulating and/or control device as a function of the expected drive power of the internal combustion engine that is determined by the prediction device chronologically before reaching the segment of the route ahead. In this way the temperature of the oil flowing through the oil circuit can be set or adjusted by the regulating and/or control device chronologically prior to reaching the segment of the route ahead, such that the temperature of the oil flowing through the oil circuit on reaching or travelling through the segment of the route ahead comprises the optimal temperature for travelling through the segment of the route ahead. For example, the target temperature value can be reduced chronologically prior to a segment of the route ahead that requires a particularly high drive power of the internal combustion engine. Such a segment of the route ahead can, for example, be a long uphill segment of the route. Likewise, the target temperature value can be increased chronologically prior to a segment of the route ahead that requires a particularly low drive power of the internal combustion engine. Such a segment of the route ahead can, for example, be a long downhill segment.

In a preferred embodiment, the prediction device comprises a weight determination device, by which the weight of the vehicle can be determined. By such a weight determination device, the drive power of the vehicle that is required in the segment of the route ahead can be reliably and simply determined. More preferably, the prediction device comprises a gradient determination device, by which the gradient of the segment of the route ahead can be determined. In this way the required drive power in the segment of the route ahead can also be simply and reliably determined by the prediction device. The gradient of the segment of the route ahead can be determined in this case for example by determining the position of the vehicle on the route thereof, for example by GPS, in combination with gradient data from a digital road map.

The target temperature value is preferably additionally also set and/or adjusted by the regulating and/or control device as a function of the current viscosity of the oil in order to be able to set the target temperature value optimally. Preferably, at least one characteristic field is stored in the regulating and/or control device for this purpose, in which the target temperature value is entered as a function of the drive power and the viscosity of the oil.

Preferably, a viscosity measuring device that is connected for signaling purposes to the regulating and/or control device is provided, by which the current viscosity of the oil flowing through the oil circuit can be measured. By such a viscosity measuring device, the current viscosity of the oil can always be determined reliably and with high accuracy. Preferably, it is provided in this case that the viscosity of the oil flowing through the oil circuit is measured by the viscosity measuring device downstream of an oil sump of the oil circuit and upstream of the oil cooler.

Alternatively and/or in addition to the viscosity measuring device, an input device is provided that is connected for signaling purposes to the regulating and/or control device and that can be operated by a person, by which the viscosity class and/or the HTHS characteristic of the oil that is currently being used can be entered, in particular manually. By using the information, it can be determined which type of oil or which oil is currently being used. By using the information about the oil that is currently being used, the current viscosity of the oil can then be determined. The determination of the current viscosity of the oil can in this case for example be carried out by a characteristic field that is stored in the regulating and/or control device and in which the viscosity of the oil being used is entered as a function of the oil temperature. The oil temperature can be measured in this case for example by a temperature sensor. Preferably, in this case it is provided that such a characteristic field is stored in the regulating and/or control device for each possible type of oil. The viscosity class and/or the HTHS characteristic of the oil can be entered into the input device in the event of, for example, an oil change.

It is further preferable that a pressure sensor with a connection to the regulating and/or control device for signaling purposes is provided, by which the pressure of the lubricating oil flowing through the oil circuit is measured, whereby the pressure sensor is disposed in or on the oil circuit downstream of an oil outlet of the bypass channel and upstream of the internal combustion engine when looking in the direction of flow of the oil. Such a pressure sensor can, for example, be used for monitoring the internal combustion engine, for regulating an oil pump or for measuring the current viscosity of the oil.

Preferably, a gearbox oil circuit is provided, by which a gearbox, which can in particular be coupled to the internal combustion engine, can be supplied with oil, whereby the oil circuit or motor oil circuit and the gearbox oil circuit are formed separately from each other. It is further preferable that a single oil circuit is provided for supplying the internal combustion engine with oil.

It is further preferable that an actuation device that can be operated by a person, in particular a button and/or a switch, is provided, by which an "Eco-Friction-Mode" can be activated and deactivated, whereby in the event of activation of the "Eco-Friction-Mode" the internal combustion engine is no longer operated at full load and/or at high partial load. In this way, in the "Eco-Friction-Mode" a higher target temperature value can be set and the fuel consumption of the internal combustion engine can be reduced.

In accordance with another aspect of the invention, in order to achieve the aforementioned object, a device for a vehicle is provided, in particular for a commercial vehicle, with an oil circuit, by which an internal combustion engine can be supplied with oil, whereby the oil circuit comprises at least one oil cooler, by which the oil flowing through the oil circuit can be cooled, and wherein at least one temperature sensor is provided, by which the temperature of the oil flowing through the oil circuit can be measured, in particular downstream of the oil cooler and upstream of the internal combustion engine. According to the invention, the temperature sensor is connected for signaling purposes to a regulating and/or control device, by which the temperature of the oil flowing through the oil circuit can be controlled and/or regulated, such that the temperature measured by the temperature sensor has a defined target temperature value. In addition, the target temperature value can be set and/or adjusted by the regulating and/or control device as a function of the drive power, in particular as a function of the drive torque, and/or as a function of the drive revolution rate, of the internal combustion engine, in particular for reducing the fuel consumption of the internal combustion engine.

The advantages provided by the device according to the invention are identical to the aforementioned advantages of the procedure according to the invention, so the same are not repeated at this point.

Furthermore, a vehicle, in particular a commercial vehicle, for performing the method according to the invention and/or with the device according to the invention is provided. The advantages resulting therefrom are also identical to the aforementioned advantages of the procedure according to the invention, so the same are also not repeated.

The advantageous configurations and/or developments of the invention described above and/or reproduced in the claims can be used individually or even in any combination with each other—apart from in cases of clear dependencies or incompatible alternatives for example.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention and the advantageous configurations and/or developments thereof as well as the advantages thereof are described in detail below using figures only by way of example.

In the figures.

DETAILED DESCRIPTION OF THE PRESENTLY PREFERRED EMBODIMENTS

Figure 1:
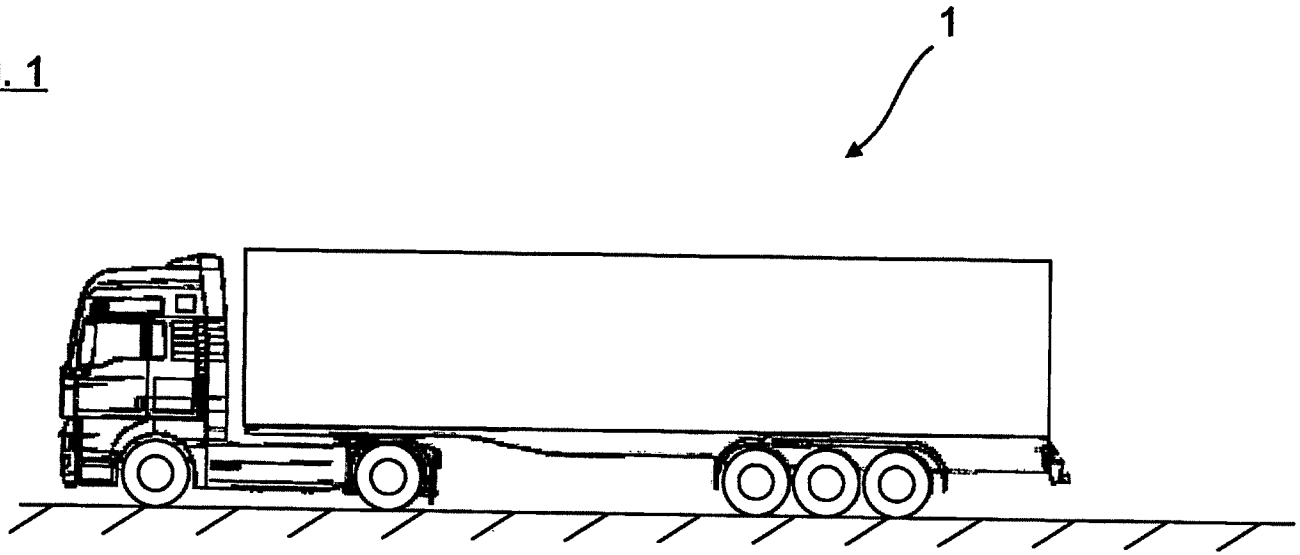
FIG. 1 shows a side view of a vehicle with the device according to the invention.
Figure 2:
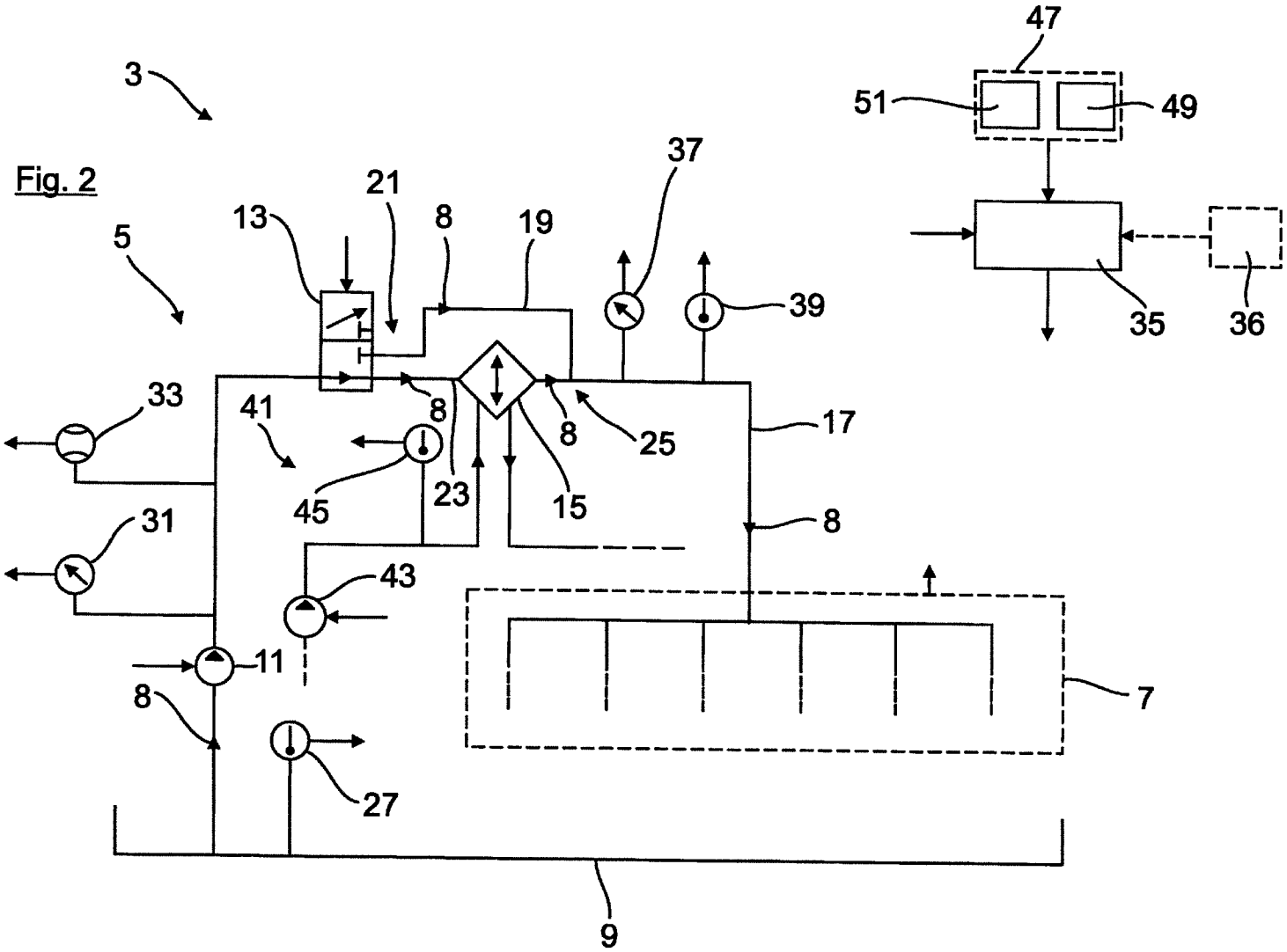
FIG. 2 shows a schematic representation, using which the design of the device is described.

In FIG. 1 a vehicle 1, here by way of example in the form of a truck, with a device 3 according to the invention (FIG. 2) is shown. The design of the device 3 is described in detail below using FIG. 2:

As is shown in FIG. 2, the device 3 comprises an oil circuit 5, by which an internal combustion engine 7, indicated in FIG. 2 with dashed lines, is supplied with oil 8. The oil circuit 5 comprises here by way of example an oil sump 9, an oil pump 11, a directional control valve 13, an oil cooler 15 and a main channel 17 when looking in the direction of flow of the oil. By the oil pump 11, the oil 8 that is collected in the oil sump 9 is sucked in and transported in the further oil circuit 5. The directional control valve 13, here by way of example in the form of a 3/2 directional control valve, forms an actuator, by which the amount of oil 8 that is passed by the oil cooler 15 and the amount of oil 8 flowing through a bypass channel 19 of the oil circuit 5 can be set or adjusted. By way of example, the oil circuit 5 branches here into the bypass channel 19 and into an oil cooler channel 23 at a branching region 21 disposed upstream of the oil cooler 15. The bypass channel 19 and the oil cooler channel 23 are re-joined in a joining region 25 disposed downstream of the oil cooler 15 when looking in the direction of flow of the oil. The branching region 21 is formed by the directional control valve 13 here by way of example. The main channel 17 of the oil circuit 5 runs downstream of the joining region 25 here. The internal combustion engine 7, the oil pump 11 and the directional control valve 13 are also connected for signaling purposes to a control unit 35 here, by which the oil pump 11 and the directional control valve 13 are controlled.

According to FIG. 2, the device 3 also comprises, by way of example, a pressure sensor 37, by which the pressure of the oil 8 flowing through the oil circuit 5 can be measured in or on the main channel 17 of the oil circuit 5. In addition, the device 3 comprises a temperature sensor 39, by which the temperature of the oil 6 flowing through the oil circuit 5 can be measured in or on the main channel 17 of the oil circuit 5. The pressure sensor 37 and the temperature sensor 39 are also connected to the control unit 35 for signaling purposes.

As is further shown in FIG. 2, the vehicle 1 comprises a temperature sensor 27, by which the temperature of the oil 8 of the oil circuit 5 collected in the oil sump 9 can be measured. Furthermore, the device 3 also comprises a pressure sensor 31, by which the pressure of the oil 8 flowing through the oil circuit 5 can be measured downstream of the oil pump 11 and upstream of the directional control valve 13 when looking in the direction of flow of the oil. Furthermore, the device also comprises, by way of example, a volumetric flow sensor 33, by which the volumetric flow of the oil 8 flowing through the oil circuit 5 can be measured downstream of the oil pump 11 and upstream of the directional control valve 13 when looking in the direction of flow of the oil. The temperature sensor 27, the pressure sensor 31 and the volumetric flow sensor 33 are connected to the control unit 35 for signaling purposes. The current viscosity of the oil 8 flowing through the oil circuit 5 downstream of the internal combustion engine 7 and upstream of the directional control valve 21 when looking in the direction of flow of the oil can be calculated by the control unit 35 from the temperature measured by the temperature sensor 27, the pressures measured by the pressure sensors 31, 37 and the volumetric flow measured by the volumetric flow sensor 33. The temperature sensor 27, the pressure sensors 31, 37, the volumetric flow sensor 33 and the control unit 35 thus form a viscosity measuring device. Alternatively, the current viscosity of the oil 8 could, for example, also be calculated from the temperature measured by the temperature sensor 27, the pressures measured by the pressure sensors 31, 37 and the revolution rate of the internal combustion engine 7.

Alternatively and/or in addition to the viscosity measuring device, the device 3 could also include an input device 36 that is indicated in FIG. 2 with dashed lines and that can be operated by a person, by which the viscosity class and/or the HTHS characteristic of the oil 8 that is currently being used can be input. Using the information, the current viscosity of the oil can also be determined.

As is also apparent from FIG. 2, the device 3 also comprises here by way of example a coolant circuit 41 that is partly shown in FIG. 2, by which the internal combustion engine 7 and the oil circuit 5 or the oil 8 flowing through the oil circuit 5 can be cooled by a coolant. The coolant circuit 41 comprises here by way of example a coolant pump 43, the oil cooler 15 as a heat absorbing heat exchanger and the internal combustion engine 7 when looking in the direction of flow of the coolant. The coolant pump 43 is here by way of example also connected to the control unit 35 for signaling purposes and is controlled by the control unit 35 as a function of a coolant temperature measured by a temperature sensor 45. The temperature of the coolant flowing through the coolant circuit 41 is measured here by way of example by the temperature sensor 45 downstream of the coolant transporting device 43 and upstream of the oil cooler 15.

The directional control valve 13, the oil pump 15 and the coolant pump 43 are controlled or regulated by the control unit 35 such that the oil temperature measured by the temperature sensor 39 has a defined target temperature value. The target temperature value is set and/or adjusted by the control unit 35 here by way of example as a function of the drive power of the internal combustion engine 7 and the current viscosity of the oil 8 that is determined by the control unit 35.

Figure 3:
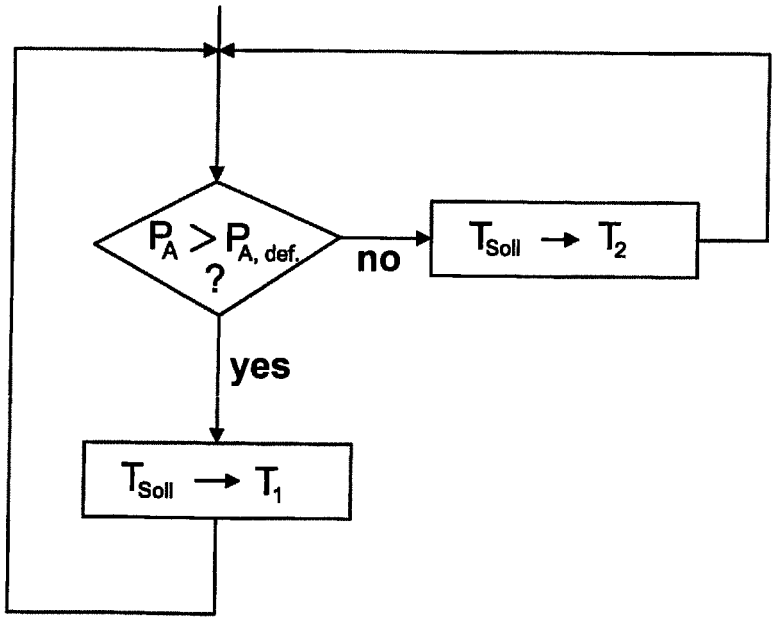
FIG. 3 shows a flow chart representation, using which the procedure according to the invention is described.

According to FIG. 3, the target temperature value is set here by way of example by the control unit 35 such that if the drive power $P_A$ of the internal combustion engine 7 exceeds a defined drive power value $P_{A,\ def.}$, a first temperature value $T_1$ is set as the target temperature value $T_{soll}$. If the drive power $P_A$ of the internal combustion engine 7 does not exceed the defined drive power value $P_{A,\ def.}$, a second temperature value $T_2$ that is greater than the first temperature value $T_1$ is set as the target temperature value $T_{soll}$ by the control unit 35. In this way the viscosity of the oil 8 flowing through the oil circuit 5 is always held as low as possible and hence the fuel consumption of the internal combustion engine 7 is reduced.

Furthermore, the device 3 also comprises here an optional prediction device 47, by which the expected drive power of the internal combustion engine 7 on a segment of the route ahead of the vehicle 1 can be determined. The target temperature value can then be set and/or adjusted here by the control unit 35 chronologically prior to reaching the segment of route ahead as a function of the expected drive power of the internal combustion engine 7 that is determined by the prediction device 47. The prediction device 47 comprises here by way of example a weight determination device, by which the weight of the vehicle can be determined. In addition, the prediction device 47 also comprises here by way of example a gradient determination device 51, by which the gradient of the segment of the route ahead can be determined. In this case, the gradient of the segment of the route ahead can be determined for example by determining the position of the vehicle on the route thereof in combination with gradient data from a digital road map.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for operating an oil circuit (5) for a vehicle, the oil circuit (5) being configured to supply oil (8) to an internal combustion engine (7), wherein the oil circuit (5) includes an oil cooler (15), configured to cool the oil (8) flowing through the oil circuit (5), and wherein at least one temperature sensor (39) is provided, the temperature sensor (39) being configured to measure the temperature of the oil (8) flowing through the oil circuit (5), downstream of the oil cooler (15) and upstream of the internal combustion engine (7), the temperature sensor (39) being connected for signaling purposes to a regulating and/or control device (13, 35), the method comprising:

controlling and/or regulating, by the regulating and/or control device (13, 35), the temperature of the oil (8) flowing through the oil circuit (5), such that the temperature measured by the temperature sensor (39) has a defined target temperature value (TSoll); and setting and/or adjusting, by the regulating and/or control device (11, 13, 43, 35), as a function of a drive power (PA) of the internal combustion engine (7), the defined target temperature value (TSoll) so as to reduce fuel consumption of the internal combustion engine (7), wherein the regulating and/or control device (13, 35) is connected for signaling purposes to a prediction device (47), by which the expected drive power (PA) of the internal combustion engine (7) in a segment of the route ahead of a vehicle (1) having the internal combustion engine (7) can be determined, the method further comprising:

setting and/or adjusting the defined target temperature value (TSoll), chronologically prior to reaching the segment of the route ahead of the vehicle (1), by the regulating and/or control device (13, 35) as a function of the expected drive power (PA) of the internal combustion engine (7) determined by the prediction device (47).

2. The method according to claim 1, further comprising:

if the drive power (PA) of the internal combustion engine (7) exceeds a defined drive power value (PA, def.), setting a first temperature value (T1) as the defined target temperature value (TSoll); and if the drive power (PA) of the internal combustion engine does not exceed the defined drive power value (PA, def.), setting a second temperature value (T2), higher than the first temperature value (T1), as the defined target temperature value (TSoll).

3. The method according to claim 1, further comprising:

in a full load mode of the internal combustion engine (7) and/or in a partial load mode of the internal combustion engine (7) in an upper partial load region, setting a temperature value of 85° C. to 100° C., as the defined target temperature value (TSoll).

4. The method according to claim 1, further comprising:

in a partial load mode of the internal combustion engine (7) in a lower and/or middle partial load region, setting a temperature value of 105° C. to 120° C. as the defined target temperature value (TSoll).

5. The method according to claim 1, wherein the oil circuit (5) further includes at least one bypass channel (19), by which at least a part of the oil (8) flowing through the oil circuit (5) can bypass the oil cooler (15), and wherein the regulating and/or control device (13, 35) includes an actuating device (13) configured to control the oil temperature of the oil circuit (5), the method further comprising:

setting and/or adjusting, by the actuating device (13), the amount of oil (8) flowing through the bypass channel (19) and the amount of oil (8) passed via the oil cooler (15); and measuring, by the temperature sensor (39), the temperature of the oil (8) flowing through the oil circuit (5) downstream of an oil outlet (25) of the bypass channel (19) and upstream of the internal combustion engine (7) when looking in the direction of flow of the oil.

6. The method according to claim 5, wherein the actuating device (13) includes at least one regulated and/or controlled directional control valve.

7. The method according to claim 6, wherein a coolant circuit (41) is provided, by which the internal combustion engine (7) and the oil circuit (5) can be cooled by a coolant, wherein in the event of a cold start of the internal combustion engine (7) all the oil (8) is passed via the oil cooler (15) by the actuating device (13).

8. The method according to claim 1, wherein the oil circuit (5) includes at least one oil pump (11), by which the oil (8) is transported through the oil circuit (5), wherein the oil pump (11) is regulated and/or controlled by the regulating and/or control device (13, 35) for controlling the oil temperature of the oil circuit (5).

9. The method according to claim 1, wherein a coolant circuit (41) is provided, by which the internal combustion engine (7) and the oil circuit (5) can be cooled by a coolant, wherein for controlling the oil temperature of the oil circuit (5) at least one component of the coolant circuit (41) that influences the cooling of the oil circuit (5) is regulated and/or controlled by the regulating and/or control device (13, 35).

10. The method according to claim 1, wherein the prediction device (47) includes a weight determination device (49), by which the weight of the vehicle (1) is determined, and/or the prediction device (47) includes a gradient determination device (51), by which the gradient of the segment of the route ahead is determined.

11. The method according to claim 1, further comprising setting and/or adjusting, by the regulating and/or control device (13, 35), the defined target temperature value (TSoll) as a function of a current viscosity of the oil (8).

12. The method according to claim 11, wherein a viscosity measuring device (27, 31, 33, 37) is provided that is connected for signaling purposes to the regulating and/or control device (13, 35), the viscosity measuring device (27, 31, 33, 37) being configured to measure the current viscosity of the oil (8) flowing through the oil circuit (5), and/or an input device (36) is provided that is connected for signaling purposes to the regulating and/or control device (13, 35) and that can be operated by a person, by which the viscosity class and/or the HTHS characteristic of the oil (8) are input.

13. A vehicle configured to perform the method according to claim 1.

14. The method according to claim 1, wherein the drive power (PA), comprises at least one selected from the group consisting of: the drive torque and the drive revolution rate.

15. The method according to claim 1, further comprising:

in a full load mode of the internal combustion engine (7) and/or in a partial load mode of the internal combustion engine (7) in an upper partial load region, setting a temperature value of 85° C. to 95° C., as the defined target temperature value (TSoll).

16. The method according to claim 1, further comprising:

in a partial load mode of the internal combustion engine (7) in a lower and/or middle partial load region, setting a temperature value of 110° C. to 120° C. as the defined target temperature value (TSoll).

17. A device for a vehicle, comprising:

an oil circuit (5) configured to supply an internal combustion engine (7) with oil (8), the oil circuit (5) comprising an oil cooler (15) configured to cool the oil (8) flowing through the oil circuit (5);

a temperature sensor (39) configured to measure the temperature of the oil (8) flowing through the oil circuit (5) downstream of the oil cooler (15) and upstream of the internal combustion engine (7) in a direction of flow of oil; and a regulating and/or control device (13, 35) to which the temperature sensor (39) is connected for signaling purposes, the regulating and/or control device (13, 35) being configured to:

control and/or regulate the temperature of the oil (8) flowing through the oil circuit (5) such that the temperature measured by the temperature sensor (39) has a defined target temperature value (TSoll), and set and/or adjust the defined target temperature value (TSoll) as a function of the drive power (PA) of the internal combustion engine (7) so as to reduce fuel consumption of the internal combustion engine (7), wherein the regulating and/or control device (13, 35) is connected for signaling purposes to a prediction device (47), by which the expected drive power (PA) of the internal combustion engine (7) in a segment of the route ahead of a vehicle (1) having the internal combustion engine (7) can be determined, the regulating and/or control device (13, 35) being further configured to:

set and/or adjust the defined target temperature value (TSoll), chronologically prior to reaching the segment of the route ahead of the vehicle (1), by the regulating and/or control device (13, 35) as a function of the expected drive power (PA) of the internal combustion engine (7) determined by the prediction device (47).

18. A vehicle having a device according to claim 17.

* * * * *